US008546056B2

(12) United States Patent
Chiba et al.

(10) Patent No.: US 8,546,056 B2
(45) Date of Patent: Oct. 1, 2013

(54) TONER AND METHOD OF MANUFACTURING TONER

(75) Inventors: Susumu Chiba, Shizuoka (JP); Hiroshi Yamashita, Shizuoka (JP); Masaki Watanabe, Shizuoka (JP); Satoyuki Sekiguchi, Shizuoka (JP); Daisuke Asahina, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/412,231

(22) Filed: Mar. 5, 2012

(65) Prior Publication Data

US 2012/0237869 A1 Sep. 20, 2012

(30) Foreign Application Priority Data

Mar. 15, 2011 (JP) ..... 2011-056162

(51) Int. Cl.
*G03G 9/087* (2006.01)

(52) U.S. Cl.
USPC ..... 430/109.4; 430/137.14; 430/137.15

(58) Field of Classification Search
USPC ..... 430/109.4, 137.14, 137.15
See application file for complete search history.

(56) References Cited

U.S. PATENT DOCUMENTS

| | | | | |
|---|---|---|---|---|
| 7,879,523 | B2 | 2/2011 | Yamashita et al. | |
| 7,939,238 | B2 | 5/2011 | Yamashita et al. | |
| 7,947,419 | B2 | 5/2011 | Sugimoto et al. | |
| 7,968,265 | B2 | 6/2011 | Sugimoto et al. | |
| 2005/0250036 | A1* | 11/2005 | Emoto et al. | 430/109.2 |
| 2009/0233212 | A1* | 9/2009 | Fujikawa et al. | 430/109.4 |
| 2009/0325099 | A1 | 12/2009 | Watanabe et al. | |
| 2010/0035170 | A1 | 2/2010 | Sugimoto et al. | |
| 2010/0075243 | A1 | 3/2010 | Shimota et al. | |
| 2010/0075245 | A1 | 3/2010 | Watanabe et al. | |
| 2010/0081075 | A1 | 4/2010 | Watanabe et al. | |
| 2010/0310980 | A1 | 12/2010 | Sugimoto et al. | |
| 2010/0330489 | A1* | 12/2010 | Inoue et al. | 430/108.4 |
| 2011/0033203 | A1 | 2/2011 | Watanabe et al. | |
| 2011/0045403 | A1 | 2/2011 | Yamashita et al. | |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0223532 | A1 | 9/2011 | Sugimoto et al. | |
| 2011/0262853 | A1 | 10/2011 | Watanabe et al. | |
| 2011/0318053 | A1 | 12/2011 | Yamashita et al. | |

FOREIGN PATENT DOCUMENTS

| | | |
|---|---|---|
| JP | 63-282752 | 11/1988 |
| JP | 6-250439 | 9/1994 |
| JP | 11-133665 | 5/1999 |
| JP | 2000-275907 | 10/2000 |
| JP | 2001-242663 | 9/2001 |
| JP | 2001-305797 | 11/2001 |
| JP | 2002-287400 | 10/2002 |
| JP | 2002-351143 | 12/2002 |
| JP | 2005-77776 | 3/2005 |
| JP | 2005-156586 | 6/2005 |
| JP | 2010-61071 | 3/2010 |

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A toner including a colorant and a binder resin is provided. The binder resin includes a polyester resin having a glass transition temperature of 18 to 40° C., a weight average molecular weight of 10,000 to 100,000, and a flow beginning temperature of 70 to 120° C. The toner has a volume average particle diameter of 3 to 10 μm.

10 Claims, 1 Drawing Sheet

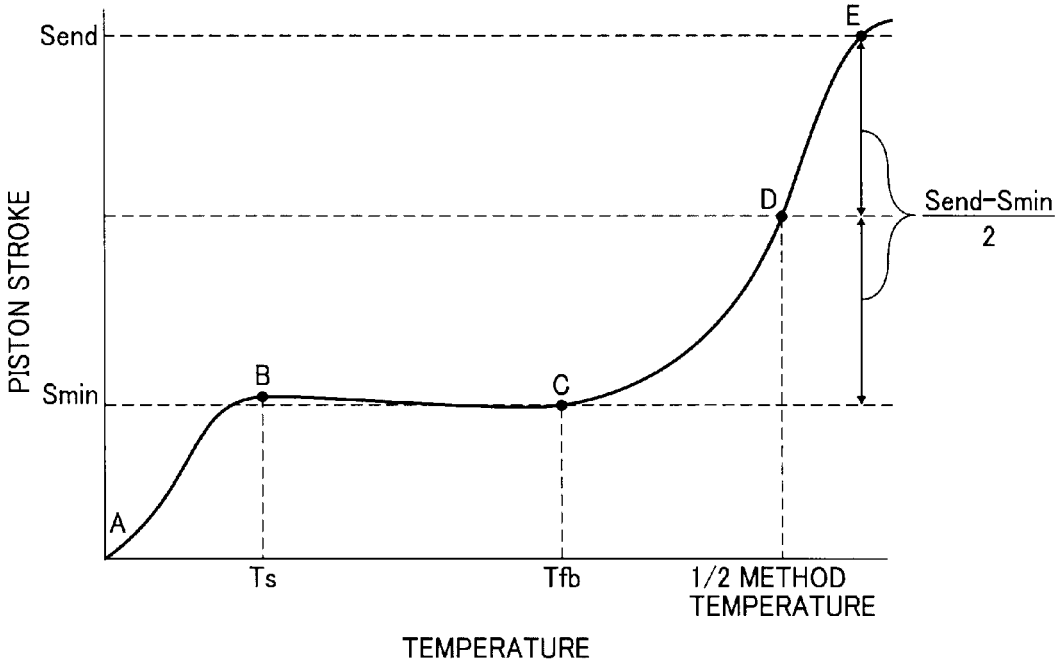
Send
Smin
PISTON STROKE
A
B
C
D
E
Ts
Tfb
1/2 METHOD
TEMPERATURE
TEMPERATURE
Send−Smin
2

TONER AND METHOD OF MANUFACTURING TONER

CROSS-REFERENCE TO RELATED APPLICATIONS

This patent application is based on and claims priority pursuant to 35 U.S.C. §119 to Japanese Patent Application No. 2011-056162, filed on Mar. 15, 2011, in the Japanese Patent Office, the entire disclosure of which is hereby incorporated herein by reference.

BACKGROUND

1. Technical Field

The present disclosure relates to a toner and a method of manufacturing toner.

2. Description of the Background

To meet recent demand for high image quality, toner is required to be much smaller. It is technically difficult to produce small-sized toner particles by typical kneading and pulverizing processes. Disadvantageously, toner particles obtained through such processes have irregular shapes and a wide particle size distribution and require a large amount of energy when being fixed on paper. When raw materials include a binder resin and a release agent such as a wax, it is likely that the kneaded mixture of the raw materials is pulverized from each interface between the binder resin and the release agent. As a result, the release agent is likely to exist at the surfaces of resulting toner particles. The release agent existing at the surface of toner particle helps releasing of the toner particle from a fixing member, but disadvantageously contaminates carrier particles, photoreceptor, or blade members.

On the other hand, toner manufacturing methods using polymerization processes have been also proposed. Generally, it is relatively easy for polymerization processes to produce small-sized toner particles with a narrow particle size distribution. It is also possible for polymerization processes to make a release agent encapsulated in resulting toner particles. For example, Japanese Patent Application Publication Nos. 63-282752 and 06-250439 each proposes an emulsion polymerization aggregation method. As another example, Japanese Patent Application Publication Nos. 2000-275907 and 2001-305797 each proposes an emulsion polymerization aggregation method.

To meet another demand for energy saving, toner is required to be fixable at much lower temperatures so as to reduce the electric power needed for warming up an image forming apparatus.

One approach for reducing fixable temperature of toner involves reducing the softening point of binder resin. However, such a low-softening-point resin portion in toner may be adhered to a fixing member and undesirably retransferred onto a next sheet of paper. This phenomenon is hereinafter referred to as hot offset. Reducing the softening point of binder resin may also reduce heat resistance of toner. As a result, the toner particles easily fused to each other (hereinafter "toner blocking") when stored in high-temperature conditions. Such toner particles may also contaminate a developing device, carrier particles, and photoreceptor.

Japanese Patent Application Publication No. 11-133665 describes a toner having a specific sphericity including an urethane-modified polyester-based binder resin. Japanese Patent Application Publication Nos. 2002-287400 and 2002-351143 each describes a small-sized toner. Each of these publications describes a toner manufacturing method in which a polyester prepolymer having an isocyanate group is addition-polymerized with an amine in an organic solvent and an aqueous medium to prepare a polymer, followed by removal of the organic solvent. Japanese Patent Application Publication No. 2005-77776 further describes in detail the removal process of the organic solvent.

Japanese Patent Application Publication Nos. 2001-242663 and 2005-156586 each describes a polymerization toner.

Japanese Patent Application Publication No. 2010-061071 describes a toner in which the difference (Tb−Ta) between the softening point Ta of the binder resin and the softening point Tb of the toner is controlled. It is described therein that the control of (Tb−Ta) is for adjusting low-temperature fixability and heat-resistant storage stability.

SUMMARY

Exemplary aspects according to embodiments of the present invention are put forward in view of the above-described circumstances, and provide a toner having a good combination of low-temperature fixability, hot offset resistance, and heat-resistant storage stability, and a method of manufacturing such a toner.

In one embodiment, a toner includes a colorant and a binder resin. The binder resin includes a polyester resin having a glass transition temperature of 18 to 40° C., a weight average molecular weight of 10,000 to 100,000, and a flow beginning temperature of 70 to 120° C. The toner has a volume average particle diameter of 3 to 10 μm.

In another embodiment, a method of manufacturing toner includes the steps of preparing a polyester resin, dissolving or dispersing toner components including a colorant and the polyester resin in an organic solvent to prepare a toner components liquid, emulsifying the toner components liquid in an aqueous medium to prepare an emulsion, and removing the organic solvent from the emulsion. The step of preparing a polyester resin further includes the step of reacting a polycarboxylic acid with a polyol, at least one of which having three or more valences, to form an intermediate polyester resin having a three-dimensional network molecular structure, and reacting at least one of a dicarboxylic acid and a diol with the intermediate polyester, to form linear molecular chains at terminals of the three-dimensional network molecular structure

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGURE is a flow curve obtained by a constant heating-rate method.

DETAILED DESCRIPTION

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

A toner according to an embodiment includes a colorant and a binder resin. The binder resin includes a polyester resin having a glass transition temperature of 18 to 40° C., a weight average molecular weight of 10,000 to 100,000, and a flow beginning temperature of 70 to 120° C. The toner has a volume average particle diameter of 3 to 10 μm.

The polyester resin has an internal dense three-dimensional network molecular structure having external linear molecular chains bonded to its terminals. The external linear molecular chains are movable even under low temperatures, and therefore contribute to decrease of glass transition temperature and improvement of low-temperature fixability of the toner. The internal three-dimensional network molecular structure, having an adequate molecular weight, is capable of keeping internal cohesive force without decreasing viscosity, and therefore contributes to improvement of low-temperature fixability, hot offset resistance, and heat-resistant storage stability.

The polyester resin has a glass transition temperature of 18 to 40° C. or 20 to 35° C. When the glass transition temperature is less than 18° C., storage stability of the toner is so poor that the toner particles easily aggregate. When the glass transition temperature is greater than 40° C., melt-viscosity of the polyester resin is so high that the toner cannot be fixable at low temperatures.

The polyester resin has a weight average molecular weight of 10,000 to 100,000 or 15,000 to 45,000. When the weight average molecular weight is less than 10,000, hot offset problem easily occurs, resulting in narrowing of the fixable temperature range. When the weight average molecular weight is greater than 100,000, melt-viscosity of the polyester resin is so high that the toner cannot be fixable at low temperatures.

The polyester resin has a flow beginning temperature of 70 to 120° C. or 75 to 115° C. When the flow beginning temperature is less than 70° C., storage stability of the toner is poor. When the flow beginning temperature is greater than 120° C., melt-viscosity of the polyester resin is so high that the toner cannot be fixable at low temperatures.

The polyester resin is obtained from polycondensation between polyol and polycarboxylic acid. More specifically, the polyester resin is obtained by reacting a polycarboxylic acid monomer with a polyol monomer, at least one of which is trivalent or more valent, to form the three-dimensional network molecular structure, and further reacting a dicarboxylic monomer and/or a diol monomer with terminals of the three-dimensional network molecular structure to form the external linear molecular chains.

In a case in which both trivalent or more valent monomers and divalent monomers simultaneously react, cross-linking structures and linear structures coexist in the resulting molecule while dense three-dimensional network structure does not exist. Cross-linking components at terminals of the molecule further react to merge the inner and external molecular structures. It is difficult for such a polyester resin having a homogenized structure to simultaneously have a glass transition temperature of 18 to 40° C. and a flow beginning temperature of 70 to 120° C.

Specific examples of usable diols include, but are not limited to, glycols (e.g., ethylene glycol, diethylene glycol, triethylene glycol, propylene glycol) and etherified bisphenols (e.g., 1,4-bis(hydroxymethyl)cyclohexane, bisphenol A). Specific examples of usable dicarboxylic acids include, but are not limited to, divalent organic acids such as adipic acid, maleic acid, fumaric acid, phthalic acid, isophthalic acid, terephthalic acid, succinic acid, and malonic acid.

Trivalent or more valent polyols and/or polycarboxylic acids are cross-linkable components. Specific examples of usable trivalent or more valent polyols include, but are not limited to, trimethylolethane, trimethylolpropane, glycerin, diglycerin, pentaerythritol, dipentaerythritol, and sorbitol. Specific examples of usable trivalent or more valent polycarboxylic acids include, but are not limited to, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In some embodiments, the polyester resin includes moieties derived from the cross-linkable components in an amount of 1 to 10% by weight, 2 to 5% by weight, or 2.0 to 3.5% by weight. When the amount of such moieties is less than 1% by weight, storage stability of the toner is poor. When the amount is greater than 10% by weight, low-temperature fixability of the toner is poor.

The binder resin may further include a resin other than the polyester resin. Specific examples of usable resins include, but are not limited to, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. In a case in which the binder resin includes the above resins, the content thereof is less than 50% by weight based on total weight of the binder resin.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorants in the toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Specific examples of the polymers of styrene or styrene derivatives include, but are not limited to, polystyrene, poly-p-chlorostyrene, and polyvinyl toluene. Specific examples of the styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

The toner according to an embodiment may be manufactured by dissolving or dispersing toner components including the binder resin and the colorant in an organic solvent to prepare a toner components liquid, emulsifying the toner components liquid in an aqueous medium, and removing the organic solvent from the resulting emulsion. Other than the binder resin and the colorant, the toner components may further include, for example, a release agent, a charge controlling agent, resin particles, a magnetic material, a compound having an active hydrogen group, and a polymer reactive with the compound having an active hydrogen group.

The toner components liquid is comprised of the organic solvent in which the toner components are dissolved or dispersed. The organic solvent may be removed during or after the process of forming toner particles.

The organic solvent may be a volatile solvent having a boiling point less than 150° C., which is easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In some embodiments, toluene, xylene, methylene chloride, 1,2-dichloroethane, chloroform, or carbon tetrachloride are used. In some embodiment, ethyl acetate is used. Two or more of these solvents can be used in combination.

In some embodiments, the used amount of the organic solvent is 40 to 300 parts by weight, 60 to 140 parts by weight, or 80 to 120 parts by weight, base on 100 parts by weight of the toner components.

In some embodiments, the toner includes a release agent having a melting point of 50 to 120° C. In a case in which such a low-melting-point release agent is dispersed in the binder resin, the toner can be effectively release from a fixing roller when the toner is fixed on a recording medium by being pressed by the fixing roller. Thus, the toner does not cause hot offset problem even when the fixing roller is not applied with any release agent such as oil.

Specific examples of such release agents include, but are not limited to, waxes. Specific examples of usable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax). Specific examples of usable waxes further include, but are not limited to, synthetic hydrocarbon waxes (e.g., Fischer-Tropsch wax, polyethylene wax) and synthetic waxes (e.g., ester wax, ketone wax, ether wax). Further, the following materials are also usable as the release agent: fatty acid amides such as 1,2-hydroxystearic acid amide, stearic acid amide, phthalic anhydride imide, and chlorinated hydrocarbon; homopolymers and copolymers of polyacrylates (e.g., n-stearyl polymethacrylate, n-lauryl polymethacrylate), which are low-molecular-weight crystalline polymers; and crystalline polymers having a long alkyl side chain. Two or more of these materials can be used in combination.

In some embodiments, the release agent has a melting point of 50 to 120° C. or 60 to 90° C. When the melting point is less than 50° C., heat-resistant storage stability of the toner may be poor. When the melting point is greater than 120° C., cold offset resistance of the toner may be poor.

In some embodiments, the release agent has a melt-viscosity of 5 to 1,000 cps or 10 to 100 cps, at a temperature 20° C. higher than the melting point. When the melt-viscosity is less than 5 cps, releasability of the toner may be poor. When the melt-viscosity is greater than 1,000 cps, hot offset resistance and low-temperature fixability of the toner may be poor.

In some embodiments, the content of the release agent in the toner is 40% by weight or less or 3 to 30% by weight. When the content of the release agent is greater than 40% by weight, fluidity of the toner may be poor.

Specific examples of usable charge controlling agents include, but are not limited to, nigrosine dyes, triphenyl-methane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Two or more of these materials can be used in combination.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

In some embodiments, the content of the charge controlling agent is 0.1 to 10 parts by weight or 0.2 to 5 parts by weight, based on 100 parts by weight of the binder resin. When the content of the charge controlling agent is less than 0.1 parts by weight, it is difficult to control charge of the toner. When the content of charge controlling agent is greater than 10 parts by weight, the toner may be excessively charged and excessively electrostatically attracted to a developing roller, resulting in poor fluidity of the developer and low image density.

The aqueous medium may contain resin particles capable of forming an aqueous dispersion thereof. Specific examples of such resins include, but are not limited to, thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Vinyl resins, polyurethane resins, epoxy resins, polyester resins, and combinations thereof are easy to form an aqueous dispersion of fine spherical particles thereof. Specific examples of usable vinyl resins include, but are not limited to, homopolymers and copolymers of vinyl monomers such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The resin particles are anionic so as not to aggregate when being used in combination with an anionic surfactant. Anionic resin particles may be obtained by treating resin particles with an anionic activator or introducing an anionic group such as carboxyl group or sulfonic group into resin particles. In some embodiments, the resin particles have a primary particle diameter of 5 to 50 nm or 10 to 25 nm, which can reliably control particle size and particle size distribution of the emulsified particles. The particle diameter of the resin particles can be measured by scanning electron microscopy, transmission election microscopy, or light scattering methods. For example, volume average particle diameter can be measured by Particle Size Distribution Analyzer LA-9920 (from Horiba, Ltd.).

In some embodiments, the resin particles are obtained in the form of aqueous dispersion. An aqueous dispersion of resin particles can be prepared as follows, for example.

(1) An aqueous dispersion of a vinyl resin is obtainable by directly subjecting raw materials including a vinyl monomer to a suspension polymerization, an emulsion polymerization, a seed polymerization, or a dispersion polymerization.

(2) An aqueous dispersion of a polyaddition or polycondensation resin (e.g., polyester resin, polyurethane resin, epoxy resin) is obtainable by dispersing a precursor (e.g., monomer, oligomer) of the resin or a solution thereof in an aqueous medium in the presence of a dispersant, and curing the precursor by application of heat or addition of a curing agent.

(3) An aqueous dispersion of a polyaddition or polycondensation resin (e.g., polyester resin, polyurethane resin, epoxy resin) is obtainable by dissolving an emulsifier in a precursor (e.g., monomer, oligomer) of the resin or a solution (preferably in a liquid state, or which may be liquefied by application of heat) thereof, and further adding water thereto to cause phase-transfer emulsification.

(4) An aqueous dispersion of a resin produced by a polymerization reaction (e.g., addition polymerization, ring-opening polymerization, polyaddition, addition condensation, polycondensation) is obtainable by pulverizing the resin into particles by a mechanical rotary pulverizer or a jet pulverizer, classifying the particles by size to collect desired-size particles, and dispersing the collected particles in an aqueous medium in the presence of a dispersant.

(5) An aqueous dispersion of a resin produced by a polymerization reaction (e.g., addition polymerization, ring-opening polymerization, polyaddition, addition condensation, polycondensation) is obtainable by dissolving the resin in a solvent, spraying the resulting resin solution to form resin particles, and dispersing the resin particles in an aqueous medium in the presence of a dispersant.

(6) An aqueous dispersion of a resin produced by a polymerization reaction (e.g., addition polymerization, ring-opening polymerization, polyaddition, addition condensation, polycondensation) is obtainable by dissolving the resin in a solvent and further adding a poor solvent to the resulting resin solution, or dissolving the resin in a solvent by application of heat and cooling the resulting resin solution, to precipitate resin particles, removing the solvents to isolate the resin particles, and dispersing the resin particles in an aqueous medium in the presence of a dispersant.

(7) An aqueous dispersion of a resin produced by a polymerization reaction (e.g., addition polymerization, ring-opening polymerization, polyaddition, addition condensation, polycondensation) is obtainable by dissolving the resin in a solvent, dispersing the resulting resin solution in an aqueous medium in the presence of a dispersant, and removing the solvent by application of heat and/or reduction of pressure.

(8) An aqueous dispersion of a resin produced by a polymerization reaction (e.g., addition polymerization, ring-opening polymerization, polyaddition, addition condensation, polycondensation) is obtainable by dissolving the resin in a solvent, dissolving an emulsifier in the resulting resin solution, and adding water thereto to cause phase-transfer emulsification.

Specific examples of usable magnetic materials include, but are not limited to, iron powder, magnetite, and ferrite. In some embodiments, a magnetic material having a whitish color is used.

The aqueous medium may be, for example, water, a water-miscible solvent, or a mixture thereof. Specific examples of usable water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone. Two or more of these materials can be used in combination.

In the present embodiment, the toner components liquid is emulsified in the aqueous medium to obtain toner particles. The toner components liquid may be kept agitated when being emulsified in the aqueous medium. The toner components liquid is emulsified in the aqueous medium using a low-speed shearing disperser, a high-speed shearing disperser, a frictional disperser, a high-pressure jet disperser, or an ultrasonic disperser, for example. In some embodiments, a high-speed shearing disperser is used that can control particle diameter of the dispersing oil droplets to 2 to 20 μm. In some embodiments, the revolution of the high-speed shearing disperser is 1,000 to 30,000 rpm or 5,000 to 20,000 rpm. In some embodiments, for batch type dispersers, the dispersing time is 0.5 to 1 minute. In some embodiments, the dispersing temperature is 0 to 150° C. or 40 to 98° C. under pressure. The higher the dispersing temperature, the easier the emulsification of dispersion.

The toner may be manufactured by another method such as a suspension polymerization method, an emulsion polymerization aggregation method, a dissolution suspension method, and a method which produces particles of an adhesive material while producing the adhesive material.

In the method which produces particles of an adhesive material while producing the adhesive material, a compound having an active hydrogen group is reacted with a polymer reactive with the compound having an active hydrogen group in an aqueous medium.

The polymer reactive with the compound having an active hydrogen group (hereinafter "prepolymer") may be, for example, a polyol resin, a polyacrylic resin, a polyester resin, an epoxy resin, or a derivative resin thereof. Two or more of these materials can be used in combination. Polyester resins are advantageous in terms of fluidity and transparency when melted.

The prepolymer has a site reactive the compound having an active hydrogen group. The site may be, for example, an isocyanate group, an epoxy group, a carboxyl group, or an acid chloride group. Two or more of these groups can be included in combination. In some embodiments, the prepolymer has an isocyanate group. In some embodiments, the prepolymer is a polyester prepolymer having an isocyanate group. Such a prepolymer is obtainable by reacting a polyisocyanate (PIC) with a polyester, which is a polycondensation product of a polyol (PO) with a polycarboxylic acid (PC), having an active hydrogen group. The active hydrogen group in the polyester may be, for example, a hydroxyl group (e.g., an alcoholic hydroxyl group, a phenolic hydroxyl group), an amino group, a carboxyl group, or a mercapto group. In some embodiments, the active hydrogen group in the polyester is an alcoholic hydroxyl group.

Usable polyols (PO) include, for example, diols (DIO) and polyols (TO) having 3 or more valences. In some embodiments, a diol (DIO) alone or a mixture of a diol (DIO) and a small amount of a polyol (TO) is used.

Specific examples of usable diols (DIO) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. In some embodiments, an alkylene glycol having 2 to 12 carbon atoms or an alkylene oxide adduct of a bisphenol is used. In some embodiments, a mixture of an alkylene oxide adduct of a bisphenol and an alkylene glycol having 2 to 12 carbon atoms is used. Specific examples of usable polyols (TO) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

Usable polycarboxylic acids (PC) include, for example, dicarboxylic acids (DIC) and polycarboxylic acids (TC) having 3 or more valences. In some embodiments, a dicarboxylic acid (DIC) alone or a mixture of a dicarboxylic acid (DIC) and a small amount of a polycarboxylic acid (TC) is used. Specific examples of usable dicarboxylic acids (DIC) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). In some embodiments, an alkenylene dicarboxylic acid having 4 to 20 carbon atoms or an aromatic dicarboxylic acid having 8 to 20 carbon atoms is used. Specific examples of the polycarboxylic acids (TC) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acids (PC).

In some embodiments, the equivalent ratio [OH]/[COOH] of hydroxyl groups [OH] in the polyol (PO) to carboxyl groups [COOH] in the polycarboxylic acid (PC) is 2/1 to 1/1, 1.5/1 to 1/1, or 1.3/1 to 1.02/1.

Specific examples of usable polyisocyanates (PIC) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, and the above polyisocyanates in which the isocyanate group is blocked with a phenol derivative, an oxime, or a caprolactam. Two or more of these materials can be used in combination.

In some embodiments, the equivalent ratio [NCO]/[OH] of isocyanate groups [NCO] in the polyisocyanate (PIC) to hydroxyl groups [OH] in the polyester resin (PE) having an active hydrogen group is 5/1 to 1/1, 4/1 to 1.2/1, or 2.5/1 to 1.5/1.

In some embodiments, the prepolymer having an isocyanate group includes units from the polyisocyanate (PIC) in an amount of 0.5 to 40% by weight, 1 to 30% by weight, or 2 to 20% by weight.

The compound having an active hydrogen group acts as an elongater or a cross-linker for elongating or cross-linking the polymer reactive with the compound having an active hydrogen group in the aqueous medium.

In some embodiments, the polymer reactive with compound having an active hydrogen group is a polyester prepolymer (A) having an isocyanate group and the compound having an active hydrogen group is an amine (B). This combination can produce a high-molecular-weight polyester by elongating and/or cross-linking reactions.

The active hydrogen group may be, for example, a hydroxyl group (e.g., an alcoholic hydroxyl group, a phenolic hydroxyl group), an amino group, a carboxyl group, or a mercapto group. Two or more of these groups can be included in the compound in combination. In some embodiments, the active hydrogen group is an alcoholic hydroxyl group.

Usable amines (B) include, for example, polyamines and amines having an active hydrogen group. The active hydrogen group may be, for example, a hydroxyl group or a mercapto group. The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. Specific examples of the diamine (B1) include, but are not limited to, aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine). Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. In some embodiments, a diamine (B1) alone or a mixture of a diamine (B1) with a small amount of a polyamine (B2) having 3 or more valences is used.

During a reaction of the prepolymer with the amine, a reaction terminator can be used to control the molecular weight of the resulting polyester. Specific examples of usable reaction terminators include, but are not limited to, monoamines (e.g., diethylamine, dibutylamine, butylamine, laurylamine) and blocked monoamines (e.g., ketimine compounds). The addition amount of the reaction terminator is determined based on a desired molecular weight of the resulting urea-modified polyester.

In some embodiments, the equivalent ratio [NCO]/[NHx] (x represents a numeral between 1 and 2) of isocyanate groups [NCO] in the prepolymer (A) to amino groups [NHx] in the amine (B) is 1/2 to 2/1, 1.5/1 to 1/1.5, or 1.2/1 to 1/1.2.

The toner may further include fine particles of an inorganic material on the surface thereof to improve fluidity, developability, and chargeability. Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination. In some embodiments, the inorganic fine particles has a primary particle diameter of 5 nm to 2 μm or 5 nm to 500 nm. In some embodiments, the content of the inorganic fine particles in the toner is 0.01 to 5.0% by weight or 0.01 to 2.0% by weight.

In some embodiments, the inorganic material (e.g., silica, titanium oxide) is surface-treated with a fluidity improving agent, such as a silane coupling agent, a silylation agent, a silane coupling agent having a fluorinated alkyl group, an organic titanate coupling agent, an aluminum coupling agent, a silicone oil, and a modified silicone oil, to improve hydrophobicity. Such a hydrophobized inorganic material does not degrade fluidity and chargeability even in high-humidity conditions.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester Resin A

A reaction vessel equipped with a condenser, a stirrer, and a nitrogen inlet pipe was charged with 61.7 parts of ethylene oxide 2 mol adduct of bisphenol A, 3.6 parts of propylene glycol, 3.1 parts of trimellitic anhydride, and 0.2 parts of dibutyltin oxide. The mixture was subjected to a reaction for 1 hour at 170° C. under normal pressures. After adding 31.5 parts of adipic acid, the mixture was further subjected to a reaction for 4 hours at 230° C. under normal pressures and subsequent 5 hours under reduced pressures of 10 to 15 mmHg. Thus, a polyester resin A was prepared.

Preparation of Polyester Resins B to H

The procedure in Example 1 was repeated except for changing the raw materials as described in Table 1. Thus, polyester resins B to H were prepared.

Preparation of Polyester Resin I

A reaction vessel equipped with a condenser, a stirrer, and a nitrogen inlet pipe was charged with 75.7 parts of ethylene oxide 2 mol adduct of bisphenol A, 0.2 parts of dibutyltin oxide, 3.8 parts of adipic acid, and 21.0 parts of isophthalic acid. The mixture was subjected to a reaction for 4 hours at 230° C. under normal pressures and subsequent 5 hours under reduced pressures of 10 to 15 mmHg. Thus, a polyester resin I was prepared.

TABLE 1

| Components (parts) | Polyester resin A | B | C | D | E | F | G | H | I |
|---|---|---|---|---|---|---|---|---|---|
| Isophthalic acid | 0.0 | 6.5 | 6.5 | 0 | 5.6 | 0.0 | 22.6 | 0.0 | 21.0 |
| Adipic acid | 31.5 | 22.7 | 23.2 | 27.5 | 19.6 | 24.6 | 4.1 | 31.5 | 3.8 |
| Ethylene oxide 2 mol adduct of bisphenol A | 61.7 | 66.0 | 67.7 | 59.5 | 61.7 | 62.0 | 60.3 | 61.7 | 75.7 |
| Propylene oxide 2 mol adduct of bisphenol A | 0.0 | 0.0 | 0 | 9.9 | 10.2 | 10.3 | 10.0 | 0.0 | 0.0 |
| Propylene glycol | 3.6 | 2.3 | 0 | 0 | 0.0 | 0.0 | 0.0 | 3.6 | 0.0 |
| Dibutyltin oxide | 0.2 | 0.2 | 0.2 | 0.2 | 0.2 | 0.2 | 0.0 | 0.2 | 0.2 |
| Trimellitic anhydride | 3.1 | 2.4 | 2.4 | 2.9 | 2.7 | 0.7 | 3.3 | 6.1 | 0.0 |

The polyester resins A to I were subjected to measurements of weight average molecular weight, acid value, glass transition temperature, and flow beginning temperature as follows. The measurement results were shown in Table 2.

Measurement of Weight Average Molecular Weight

Weight average molecular weight is measured by an instrument GPC-8020 (from Tosoh Corporation) equipped with columns TSK-GEL SUPER HZ2000, TSK-GEL SUPER HZ2500, and TSK-GEL SUPER HZ3000 as follows. After stabilizing the columns in a heat chamber at 40° C., flow THF (tetrahydrofuran) in the columns at a flow rate of 0.35 mL/min. Inject 10 to 200 μL of a THF solution of each polyester resin having a concentration of 0.05 to 0.6% by weight. Determine number average molecular weight (Mn), weight average molecular weight (Mw), and peak top molecular weight from the resulting molecular weight distribution with reference to a calibration curve compiled from several kinds of monodisperse polystyrene standard samples. Each of the monodisperse polystyrene standard samples has a molecular weight of $1\times10^2$, $8.5\times10^2$, $1.6\times10^3$, $2.83\times10^3$, $4.6\times10^3$, $6.7\times10^3$, $1.11\times10^4$, $1.98\times10^4$, $2.78\times10^4$, and $4.5\times10^4$. The instrument is equipped with a refractive index detector.

Measurement of Acid Value

Acid value was measured based on a method according to JIS K0070-1992 as follows. First, prepare a sample solution by dissolving 0.5 g of each polyester resin in 120 mL of toluene by agitating them for about 1 hour at room temperature (23° C.) and further adding 30 mL of ethanol thereto. Titrate the sample solution with an N/10 potassium hydroxide alcohol solution and determine the consumed amount of the potassium hydroxide alcohol solution (ml). Calculate acid value from the following equation:

$$\text{Acid Value}=\text{KOH (ml)}\times N\times 56.1/W$$

wherein KOH represents the consumed amount of the potassium hydroxide alcohol solution, N represents the factor of the potassium hydroxide alcohol solution, and W represents the weight of the sample.

Measurement of Flow Beginning Temperature

Flow beginning temperature is measured with a flowtester CFT500 (from Shimadzu Corporation) employing a constant heating-rate method based on a method according to JIS K71201 as follows. A 1-$cm^3$ sample pellet is heated at a heating rate of 3° C./min while being pressed with a piston at a pressure of 30 $kg/cm^2$ to flow out of a die hole having a diameter of 0.5 mm and a length of 1.0 mm. FIGURE is a flow curve obtained by the constant heating-rate method. In FIGURE, A represents measurement beginning point, B represents softening point (Ts), C represents flow beginning point (Tfb), D represents ½ flow point, and E represents measurement end point. The constant heating-rate method permits continuous determination of solid region, transition region, rubbery elastic region, and flow region of the sample. The flow beginning temperature Tfb is a temperature at which the sample begins flowing out of the die hole.

Measurement of Glass Transition Temperature

Glass transition temperature is measured by a thermal analyzer THERMO PLUS TG8110 and a TG-DSC system TAS-100 (both from Rigaku Corporation) as follows. Put an aluminum container containing about 10 mg of a sample on a holder unit and set in an electric furnace. Subject the sample to a DSC measurement in which the sample is heated from room temperature to 150° C. at a heating rate of 20° C./min, kept at 150° C. for 10 minutes, cooled to room temperature and kept for 10 minutes, and reheated to 150° C. at a heating rate of 20° C./min under nitrogen atmosphere, to obtain an endothermic curve. Determine glass transition temperature from an intersection of a tangent line and the baseline of the endothermic curve using an analysis system in the TAS-100.

TABLE 2

| Polyester resin | Cross-linkable components (%) | Glass transition temperature (° C.) | Weight average molecular weight | Flow beginning temperature (° C.) | Acid value (KOHmg/g) |
|---|---|---|---|---|---|
| A | 3.1 | 21.0 | 42,000 | 118.1 | 17.4 |
| B | 2.4 | 28.9 | 15,700 | 76.5 | 16.1 |
| C | 2.4 | 37.1 | 23,500 | 85.4 | 18.2 |
| D | 2.9 | 23.4 | 14,800 | 70.4 | 18.0 |
| E | 2.7 | 24.5 | 5,000 | 61.3 | 17.7 |
| F | 0.7 | 17.8 | 12,000 | 55.6 | 18.2 |
| G | 3.0 | 49.0 | 10,700 | 84.5 | 7.7 |
| H | 6.2 | 25.2 | 65,000 | 122 | 20.2 |
| I | 0 | 43 | 4,500 | 72.0 | 22.1 |

Example 1

Preparation of Toner

First, 1,000 parts of water, 540 parts of a carbon black (PRINTEX 35 from Degussa) having a DBP oil absorption of 42 ml/100 g and a pH of 9.5, and 1,200 parts of the polyester resin F were mixed using a HENSCHEL MIXER (from Mitsui Mining and Smelting Co., Ltd.). The resulting mixture was kneaded for 30 minutes at 150° C. using double rolls, the kneaded mixture was then rolled and cooled, and the rolled mixture was then pulverized into particles using a pulverizer (from Hosokawa Micron Corporation). Thus, a master batch was prepared.

An aqueous medium was prepared by mixing and agitating 306 parts of ion-exchange water, 265 parts of a 10% suspension of tricalcium phosphate, and 0.2 parts of sodium dodecylbenzenesulfonate.

In a beaker, 75 parts of the polyester resin A were dissolved in 130 parts of ethyl acetate. Further, 5 parts of a modified paraffin wax (HNP-11 from Nippon Seiro Co., Ltd.) and 10 parts of the master batch were added to the beaker. The resulting mixture was subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thereafter, 2.7 parts of the ketimine compound were further added to the mixture. Thus, a toner components liquid was prepared.

While agitating 150 parts of the aqueous medium in a vessel at a revolution of 12,000 rpm using a TK HOMOMIXER (from PRIMIX Corporation), 100 parts of the above-prepared toner components liquid were added and mixed for 10 minutes. Thus, an emulsion slurry was prepared.

A flask equipped with a stirrer and a thermometer was charged with 100 parts of the emulsion slurry. The emulsion slurry was agitated for 12 hours at 30° C. at a peripheral speed of 20 m/min so that the organic solvents were removed therefrom. Thus, a dispersion slurry was prepared.

Next, 100 parts of the dispersion slurry was filtered under reduced pressures to obtain a wet cake (i). The wet cake (i) was then mixed with 100 parts of ion-exchange water using a TK HOMOMIXER for 10 minutes at a revolution of 12,000 rpm, followed by filtration, thus obtaining a wet cake (ii). The wet cake (ii) was mixed with 300 parts of ion-exchange water using a TK HOMOMIXER for 10 minutes at a revolution of 12,000 rpm, followed by filtration. This operation was repeated twice, thus obtaining a wet cake (iii). The wet cake (iii) was mixed with 20 parts of a 10% aqueous solution of sodium hydroxide using a TK HOMOMIXER for 30 minutes at a revolution of 12,000 rpm, followed by filtration under reduced pressures, thus obtaining a wet cake (iv). The wet cake (iv) was mixed with 300 parts of ion-exchange water using a TK HOMOMIXER for 10 minutes at a revolution of 12,000 rpm, followed by filtration, thus obtaining a wet cake (v). The wet cake (v) was mixed with 300 parts of ion-exchange water using a TK HOMOMIXER for 10 minutes at a revolution of 12,000 rpm, followed by filtration. This operation was repeated twice, thus obtaining a wet cake (vi). The wet cake (vi) was mixed with 20 parts of a 10% hydrochloric acid using a TK HOMOMIXER for 10 minutes at a revolution of 12,000 rpm, followed by filtering, thus obtaining a wet cake (vii). The wet cake (vii) was mixed with 300 parts of ion-exchange water using a TK HOMOMIXER for 10 minutes at a revolution of 12,000 rpm, followed by filtration. This operation was repeated twice, thus obtaining a wet cake (viii).

The wet cake (viii) was dried by a circulating drier for 48 hours at 45° C., and filtered with a mesh having openings of 75 μm. Thus, a mother toner A was prepared.

The mother toner A in an amount of 100 parts was mixed with 1.0 part of a hydrophobized silica (H2000 from Clamant Japan K.K.) using a HENSCHEL MIXER (from Mitsui Mining Co., Ltd.) at a peripheral speed of 30 msec for 30 seconds, followed by a pause for 1 minute. This mixing operation was repeated for 5 times (5 cycles). Thus, a toner 1 was prepared.

Example 2

The procedure in Example 1 was repeated except for replacing the polyester resin A with the polyester resin B. Thus, a toner 2 was prepared.

Example 3

The procedure in Example 1 is repeated except for replacing the polyester resin A with the polyester resin C. Thus, a toner 3 is prepared.

Example 4

The procedure in Example 1 is repeated except for replacing the polyester resin A with the polyester resin D. Thus, a toner 4 is prepared.

Comparative Example 1

The procedure in Example 1 was repeated except for replacing the polyester resin A with the polyester resin E. Thus, a comparative toner 1 was prepared.

Comparative Example 2

The procedure in Example 1 is repeated except for replacing the polyester resin A with the polyester resin F. Thus, a comparative toner 2 is prepared.

Comparative Example 3

The procedure in Example 1 was repeated except for replacing the polyester resin A with the polyester resin G. Thus, a comparative toner 3 was prepared.

Comparative Example 4

The procedure in Example 1 is repeated except for replacing the polyester resin A with the polyester resin H. Thus, a comparative toner 4 is prepared.

Comparative Example 5

The procedure in Example 1 was repeated except for replacing the polyester resin A with the polyester resin I. Thus, a comparative toner 5 was prepared.

Each of the mother toners was subjected to a measurement of volume average particle diameter (Dv) and number average particle diameter (Dn) as follows. The measurement results are shown in Table 3.

Measurement of Volume Average Particle Diameter (Dv) and Number Average Particle Diameter (Dn)

Volume average particle diameter (Dv) and number average particle diameter (Dn) are measured by a particle size analyzer MULTISIZER III (from Beckman Coulter, Inc.) having an aperture size of 100 μm and an analysis software program Beckman Coulter Multisizer 3 Version 3.51 as follows. First, charge a 100-mL glass beaker with 0.5 mL of a 10% surfactant (an alkylbenzene sulfonate NEOGEN SC-A from Dai-ichi Kogyo Seiyaku Co., Ltd.). Add 0.5 g of a sample to the beaker and mix with a micro spatula. Further add 80 mL of ion-exchange water to the beaker. Subject the resulting dispersion to a dispersion treatment for 10 minutes using an ultrasonic disperser (W-113 MK-II from Honda Electronics). Subject the dispersion to a measurement by the MULTISIZER III using a measuring solution ISOTON III (from Beckman Coulter, Inc.). During the measurement, the amount of the dispersion is controlled so that the sample concentration is within 8±2%.

Preparation of Carrier

First, 100 parts of a silicone resin (an organo straight silicone), 5 parts of γ-(2-aminoethyl)aminopropyl trimethoxysilane, and 10 parts of a carbon black were dispersed in 100 parts of toluene for 20 minutes using a HOMOMIXER. Thus, a resin layer coating liquid was prepared. The resin layer coating liquid was applied to the surfaces of 1,000 parts of spherical magnetite particles having an average particle diameter of 50 μm using a fluidized-bed coating device. Thus, a carrier is prepared.

Preparation of Developers

Each of the toners prepared above in an amount of 5 parts and the carrier in an amount of 95 were mixed by a ball mill to prepare a developer. The developers were subjected to the following evaluations. The evaluation results are shown in Table 3.

Evaluation of Fixability

A copier (MF-200 from Ricoh Co., Ltd.) employing a TEFLON fixing roller was modified so that the fixing roller temperature was variable. Each of the toners was set in the copier and toner images were produced while varying the fixing roller temperature at an interval of 5° C. to determine the maximum and minimum fixable temperatures. The minimum fixable temperature is a temperature below which the residual image density rate falls below 70% after a toner image is rubbed with a pad. In this test, the toner image was fixed at a linear speed of 120 to 150 mm/sec, a surface pressure of 1.2 kgf/cm$^2$, and a nip width of 3 mm. The maximum fixable temperature is a temperature above which visually observable hot offset occurs in a 1 cm×1 cm solid toner image including toner in an amount of 0.40±0.1 mg/cm$^2$. In this test, the solid toner image was fixed at a linear speed of 50 mm/sec, a surface pressure of 2.0 kgf/cm$^2$, and a nip width of 4.5 mm. The lower the minimum fixable temperature, the lower the consumed electric power. Low-temperature fixability and offset resistance are each graded into the following three ranks.

Low-Temperature Fixability

A: The minimum fixable temperature was less than 125° C.

B: The minimum fixable temperature was not less than 125° C. and less than 135° C.

C: The minimum fixable temperature was not less than 135° C.

Hot Offset Resistance

A: The maximum fixable temperature was not less than 190° C.

B: The maximum fixable temperature was not less than 180° C. and less than 190° C.

C: The maximum fixable temperature was less than 180° C.

Evaluation of Heat-Resistant Storage Stability

A 50-ml glass vial was filled with a toner. The vial was left in a constant-temperature chamber at 50° C. for 24 hours, followed by cooling. Thereafter, the toner was subjected to a measurement of penetration based on a method according to JIS K2235-1991. Heat-resistant storage stability was graded into the following three ranks in terms of penetration. The greater the penetration, the better the heat-resistant storage stability. The rank C is commercially unviable.

A: The penetration was not less than 10 mm.

B: The penetration was not less than 5 mm and less than 10 mm.

C: The penetration was less than 5 mm.

TABLE 3

| | Poly-seter Resin | Dv (μm) | Dv/Dn | Low-tempera-ture Fixability | Heat-resistant Storage Stability | Hot Offset Resis-tance |
|---|---|---|---|---|---|---|
| Example 1 | A | 5.4 | 1.14 | B | A | A |
| Example 2 | B | 5.6 | 1.15 | A | A | A |
| Example 3 | C | 5.5 | 1.13 | B | A | A |
| Example 4 | D | 5.3 | 1.15 | A | B | A |

TABLE 3-continued

| | Poly-seter Resin | Dv (μm) | Dv/Dn | Low-tempera-ture Fixability | Heat-resistant Storage Stability | Hot Offset Resis-tance |
|---|---|---|---|---|---|---|
| Comparative Example 1 | E | 5.2 | 1.13 | A | C | C |
| Comparative Example 2 | F | 5.3 | 1.12 | A | C | B |
| Comparative Example 3 | G | 4.8 | 1.15 | C | A | B |
| Comparative Example 4 | H | 5.8 | 1.16 | B | B | A |
| Comparative Example 5 | I | 5.2 | 1.14 | C | A | C |

Additional modifications and variations of the present invention are possible in light of the above teachings. It is therefore to be understood that within the scope of the appended claims the invention may be practiced other than as specifically described herein.

What is claimed is:

1. A toner, comprising:

a colorant; and a binder resin, the binder resin including a polyester resin having a glass transition temperature of 18 to 40° C., a weight average molecular weight of 10,000 to 100,000, and a flow beginning temperature of 70 to 120° C., wherein the toner has a volume average particle diameter of 3 to 10 μm.

2. The toner according to claim 1, wherein the polyester resin includes moieties derived from cross-linkable monomers in an amount of 1 to 10% by weight.

3. The toner according to claim 1, wherein the polyester resin has an acid value of 1 to 40 mgKOH/g.

4. The toner according to claim 1, wherein the binder resin includes the polyester resin in an amount of 50 to 100% by weight.

5. The toner according to claim 1, further comprising inorganic fine particles, the inorganic fine particles being present on a surface of the toner.

6. The toner according to claim 1, wherein a ratio (Dv/Dn) of the volume average particle diameter (Dv) to a number average particle diameter (Dn) of the toner is 1.00 to 1.30.

7. The toner according to claim 1, wherein the polyester resin has a three-dimensional network molecular structure having linear molecular chains at its terminals.

8. The toner according to claim 1, wherein the toner is manufactured by a method comprising:

dissolving or dispersing toner components in an organic solvent to prepare a toner components liquid, the toner components including the colorant and the binder resin;

emulsifying the toner components liquid in an aqueous medium.

9. The toner according to claim 7, wherein the toner is manufactured by a method comprising:

preparing the polyester resin, including:

reacting a polycarboxylic acid with a polyol, at least one of which having three or more valences, to form an intermediate polyester resin having the three-dimensional network molecular structure; and reacting at least one of a dicarboxylic acid and a diol with the intermediate polyester, to form the linear molecular chains at terminals of the three-dimensional network molecular structure;

dissolving or dispersing toner components in an organic solvent to prepare a toner components liquid, the toner components including the colorant and the binder resin;

emulsifying the toner components liquid in an aqueous medium to prepare an emulsion; and removing the organic solvent from the emulsion.

10. A method of manufacturing toner as claimed in claim 1, comprising:

preparing a polyester resin, including:

reacting a polycarboxylic acid with a polyol, at least one of which having three or more valences, to form an intermediate polyester resin having a three-dimensional network molecular structure; and reacting at least one of a dicarboxylic acid and a diol with the intermediate polyester, to form linear molecular chains at terminals of the three-dimensional network molecular structure;

dissolving or dispersing toner components in an organic solvent to prepare a toner components liquid, the toner components including a colorant and the polyester resin;

emulsifying the toner components liquid in an aqueous medium to prepare an emulsion; and removing the organic solvent from the emulsion.

* * * * *